US008449140B2

(12) United States Patent
Martin et al.

(10) Patent No.: US 8,449,140 B2
(45) Date of Patent: May 28, 2013

(54) LIGHTING ARRANGEMENT USING LEDS

(75) Inventors: John D. Martin, Watertown, WI (US); Chamy ChiaChen Lutz, Oconomowoc, WI (US); Lisa M. Small, Watertown, WI (US)

(73) Assignee: C-M Glo, LLC, Water town, WI (US)

( * ) Notice: Subject to any disclaimer, the term of this patent is extended or adjusted under 35 U.S.C. 154(b) by 274 days.

(21) Appl. No.: 12/882,910

(22) Filed: Sep. 15, 2010

(65) Prior Publication Data

US 2011/0069486 A1 Mar. 24, 2011

Related U.S. Application Data

(60) Provisional application No. 61/243,800, filed on Sep. 18, 2009.

(51) Int. Cl.
*F21V 1/00* (2006.01)

(52) U.S. Cl.
USPC ..... 362/235; 362/217.02; 362/219; 362/246; 362/244; 362/363

(58) Field of Classification Search
USPC ..... 362/363, 219, 240, 246, 244, 217.02
See application file for complete search history.

(56) References Cited

U.S. PATENT DOCUMENTS

| | | | |
|---|---|---|---|
| 818,724 | A | 4/1906 | Williams |
| 1,348,698 | A | 8/1920 | Coulson |
| 1,820,913 | A | 9/1931 | Kelly et al. |
| 1,826,389 | A | 10/1931 | Fullerton |
| 2,058,900 | A | 10/1936 | McDonald |
| 2,173,371 | A | 9/1939 | Penoyer |
| 2,354,367 | A | 7/1944 | Ford |
| 3,208,174 | A | 9/1965 | Wrenshall |
| 3,968,584 | A | 7/1976 | Kingston |
| 4,607,317 | A | 8/1986 | Lin |
| 4,630,180 | A | 12/1986 | Muraki et al. |
| 4,901,207 | A | 2/1990 | Sato et al. |
| 4,941,072 | A | 7/1990 | Yasumoto et al. |

(Continued)

FOREIGN PATENT DOCUMENTS

| | | |
|---|---|---|
| DE | 29603006 | 4/1996 |
| DE | 29706201 | 7/1997 |

(Continued)

OTHER PUBLICATIONS

Tivoli Industires, Inc., "Electroluminescent Accent and Guide Lighting" product brochure, pp. 1-2.

(Continued)

*Primary Examiner* — Ali Alavi
(74) *Attorney, Agent, or Firm* — Boyle Fredrickson, S.C.

(57) ABSTRACT

A lighting arrangement using LEDs that has an elongated translucent diffuser having a flat upper surface along the length of the diffuser. The transverse cross-section of the elongate translucent diffuser may have various shapes, all having substantially flat tops, including but not limited to quadrangular, rectangular, trapezoidal, and non-isosceles variations of these shapes. The elongated translucent diffuser is mounted on an elongated housing of substantially the same length to support the diffuser. The elongated housing may be solid or hollow and may contain the LEDs and circuit board, or the LEDs and circuit board may be contained within the elongated translucent diffuser. The LEDs are configured to transmit light through the diffuser so that the emitted light simulates light from a traditional neon tube.

24 Claims, 10 Drawing Sheets

U.S. PATENT DOCUMENTS

| | | | | |
|---|---|---|---|---|
| 4,976,057 | A | 12/1990 | Bianchi | |
| 5,027,259 | A | 6/1991 | Chujko | |
| 5,032,960 | A | 7/1991 | Katoh | |
| 5,057,981 | A | 10/1991 | Bowen et al. | |
| 5,130,761 | A | 7/1992 | Tanaka | |
| 5,161,872 | A | 11/1992 | Sasaki et al. | |
| 5,295,047 | A | 3/1994 | Windross | |
| 5,365,411 | A | 11/1994 | Rycroft et al. | |
| 5,526,236 | A | 6/1996 | Burnes et al. | |
| 5,539,623 | A | 7/1996 | Gurz et al. | |
| 5,567,034 | A | 10/1996 | Dietewich et al. | |
| 5,582,480 | A | 12/1996 | Zwick et al. | |
| 5,604,480 | A | 2/1997 | Lamparter | |
| 5,607,227 | A | 3/1997 | Yasumoto et al. | |
| 5,634,287 | A | 6/1997 | Lamparter | |
| 5,687,500 | A | 11/1997 | Lamparter | |
| 5,729,925 | A | 3/1998 | Prothero | |
| 5,812,714 | A | 9/1998 | Hulse | |
| 5,954,423 | A | 9/1999 | Logan et al. | |
| 5,964,051 | A | 10/1999 | Loeber et al. | |
| 5,964,981 | A | 10/1999 | Nelson et al. | |
| 6,042,248 | A | 3/2000 | Hannah et al. | |
| 6,127,675 | A | 10/2000 | Nakamura et al. | |
| 6,146,006 | A | 11/2000 | Cross | |
| 6,158,882 | A | 12/2000 | Bischoff, Jr. | |
| 6,167,648 | B1 | 1/2001 | Dimmick | |
| 6,168,302 | B1 | 1/2001 | Hulse | |
| 6,173,517 | B1 * | 1/2001 | Eibner et al. | 40/544 |
| 6,193,385 | B1 | 2/2001 | Maki et al. | |
| 6,217,201 | B1 | 4/2001 | Hulse | |
| 6,244,734 | B1 | 6/2001 | Hulse | |
| 6,260,991 | B1 | 7/2001 | Hulse | |
| 6,361,186 | B1 * | 3/2002 | Slayden | 362/241 |
| 6,366,727 | B1 | 4/2002 | Nojiri et al. | |
| 6,481,130 | B1 | 11/2002 | Wu | |
| 6,550,952 | B1 | 4/2003 | Hulse et al. | |
| 6,557,282 | B1 | 5/2003 | Cleaver | |
| 6,582,103 | B1 | 6/2003 | Popovich et al. | |
| 6,592,238 | B2 | 7/2003 | Cleaver et al. | |
| 6,676,284 | B1 | 1/2004 | Wynne Willson | |
| 6,761,472 | B1 | 7/2004 | Cleaver et al. | |
| 6,834,979 | B1 | 12/2004 | Cleaver et al. | |
| 6,874,924 | B1 | 4/2005 | Hulse et al. | |
| 6,896,398 | B2 | 5/2005 | Chambers et al. | |
| 6,948,828 | B1 | 9/2005 | Chambers et al. | |
| 6,953,262 | B2 | 10/2005 | Cleaver et al. | |
| 7,008,097 | B1 | 3/2006 | Hulse | |
| 7,011,421 | B2 | 3/2006 | Hulse et al. | |
| 7,012,379 | B1 | 3/2006 | Chambers et al. | |
| 7,048,413 | B2 | 5/2006 | Fan | |
| 7,086,769 | B1 | 8/2006 | Thompson et al. | |
| 7,118,251 | B1 | 10/2006 | Chambers et al. | |
| 7,178,926 | B2 | 2/2007 | Hulse | |
| 7,186,005 | B2 | 3/2007 | Hulse | |
| 7,188,970 | B2 | 3/2007 | Cleaver et al. | |
| 7,192,161 | B1 | 3/2007 | Cleaver et al. | |
| 7,207,692 | B1 | 4/2007 | Hulse | |
| 7,229,196 | B2 | 6/2007 | Hulse | |
| 7,241,039 | B2 | 7/2007 | Hulse | |
| 7,264,366 | B2 | 9/2007 | Hulse | |
| 7,264,367 | B2 | 9/2007 | Hulse | |
| 7,331,697 | B1 | 2/2008 | Hulse | |
| 7,377,787 | B1 | 5/2008 | Eriksson | |
| 7,467,486 | B2 * | 12/2008 | Kaoh | 40/551 |
| 7,506,997 | B1 | 3/2009 | Eriksson | |
| 2005/0111236 | A1 | 5/2005 | Hulse | |
| 2005/0195603 | A1 | 9/2005 | Hulse | |
| 2005/0231950 | A1 | 10/2005 | Cleaver et al. | |
| 2006/0198119 | A1 | 9/2006 | Hulse | |
| 2007/0001613 | A1 | 1/2007 | Hulse | |
| 2007/0009210 | A1 | 1/2007 | Hulse | |
| 2007/0014096 | A1 | 1/2007 | Hulse | |
| 2007/0064409 | A1 | 3/2007 | Hulse | |
| 2007/0133204 | A1 | 6/2007 | Hulse et al. | |
| 2008/0169746 | A1 | 7/2008 | Hulse | |
| 2009/0091915 | A1 | 4/2009 | Eriksson | |
| 2009/0091931 | A1 | 4/2009 | Eriksson | |

FOREIGN PATENT DOCUMENTS

| | | |
|---|---|---|
| DE | 29803723 | 2/1998 |
| JP | 6-12021 | 1/1984 |
| JP | 62-41185 | 3/1986 |
| JP | 61-165583 | 10/1986 |
| JP | 61-286878 | 12/1986 |
| JP | 3007923 | 12/1994 |
| JP | 2000-29406 | 1/2000 |
| JP | 2000-307152 | 11/2000 |
| JP | 55-97903 | 7/2010 |
| WO | 99/06759 | 2/1999 |
| WO | 99/39319 | 8/1999 |
| WO | 00/14705 | 3/2000 |
| WO | 00/31463 | 6/2000 |
| WO | 02/061328 | 8/2002 |

OTHER PUBLICATIONS

Neo-Neon, "2000 The Light of the Next Millenium" Lighting System Catalog: 1999-2000, Duralight product information pp. 10-21.

Brazilian Patent Office, "Examiner's Technical Opinion", English translation of the most relevant parts of Examiners Opinion in Brazilian application No. PI0116848-7, Nov. 2009.

* cited by examiner

LIGHTING ARRANGEMENT USING LEDS

CROSS-REFERENCE TO RELATED APPLICATIONS

This application claims priority to U.S. Provisional Patent Application Ser. No. 61/243,800 filed on Sep. 18, 2009, the entirety of which is hereby incorporated by reference.

BACKGROUND OF THE INVENTION

The present invention relates generally to a sign, and more particularly to an illuminated sign incorporating an elongate diffuser or waveguide which provides a novel and attractive surface for emitting substantially uniform light.

Signs for storefronts and the like are well known throughout the art. For instance, signs for indicating whether a particular business is open, i.e., open signs, and the like are well known. Such signs have traditionally utilized neon for illumination of the sign. In such signs, a number of tubes are arranged to spell out the word or words desired such as, e.g., "OPEN". Such tubes, traditionally round hollow glass, are filled with neon, argon, xenon, or other gases, and an electrical charge is applied to the gas by way of a pair of opposed electrodes at either end of the tube to thereby illuminate the gas and the tube. Such signs, however, suffer from a number of disadvantages. Neon tubes tend to be very brittle and susceptible to accidental breakage. During the manufacture of a neon sign the glass tubes, typically manufactured as straight linear hollow tubes, are heated and deformed into the illuminated elements of the sign, for example, to spell out the word "OPEN," but must still retain an unobstructed hollow center with one or more ends for applying an electrical charge. The process is thus limited by the constraints of illuminating the tube with neon gas within, and the constraints imposed by the available traditional neon glass tubing which limits the design and appearance of the finished sign and requires a substantially complex fabrication process. Further, neon tubing is relatively expensive and thus replacement of the tubes is undesirable and cost prohibitive.

As such, it has become known to provide signs that simulate the appearance of neon tubing by using a series of light emitting members such as, for example, light emitting diodes ("LEDs") arranged along the length of a housing and directed to emit substantially uniform light at a diffuser or waveguide to thereby illuminate the waveguide in a manner that simulates the appearance of neon. Such constructions are advantageous with respect to traditional neon signs in that the energy needs of these signs are quite small thereby reducing costs to the user. Further, as compared to traditional neon signs, the waveguides and housing may be produced from a relatively lighter weight and more malleable or moldable material other than glass, such as a plastic. However, such signs, despite the potential for modification of the waveguide shape made of more malleable material, continue to mimic the rounded surface of a glass tube. Diverging from the rounded light emitting surface of the neon glass tube can allow designs that are novel and thus stand out from traditional neon signs, thus becoming more noticeable and potentially more attractive to the human user. In addition, the waveguide can be designed to be more structurally sound, and can be fabricated without relying on bending or deforming glass in a secondary manufacturing step. Thus, it is desired to provide a sign that overcomes each of the foregoing disadvantages while maintaining the high quality illumination provided by the sign.

SUMMARY OF THE INVENTION

The present inventors have recognized that a significant feature of an illuminated sign is the structure and appearance of the light-emitting waveguide. Providing a waveguide that is practical, structurally and in terms of material cost, and novel or attractive, can positively affect the user's experience with the illuminated sign.

Specifically, the invention contemplates a simulated neon light including at least one elongated translucent diffuser or waveguide having an inner surface, an outer surface, and a hollow interior. The outer surface of the diffuser has a flat top portion extending substantially over the length of the elongated translucent diffuser. The light includes a housing that is configured for attachment to the translucent diffuser, and a series of light emitting diodes contained within the housing and aligned with a long axis of the elongated translucent diffuser. With this construction, the light emitting diodes when energized emit light that strikes the inner surface of the elongated translucent diffuser, such that a portion of the light is diffused and emitted by the flat portion of the outer surface. An electrical power source energizes the light emitting diodes. The simulated neon light thus has a novel look for attracting the user and enhancing their visual experience.

The housing may have an interior space and at least one open side, or the diffuser may be mounted to a support structure that is substantially solid. The diffuser may have a closed boundary extending substantially over the length of the diffuser and forming a hollow interior. The diffuser may be in the form of an assembly having a top wall portion and a securably attached bottom wall wherein the bottom wall may be a transparent or a translucent material. The diffuser may have a bottom wall that may be assembled so as to allow insertion of components, and constructed with minimal diffusive materials. Alternatively, the bottom wall may be opaque to light to allow light to only be emitted from the top wall portion of the diffuser when LEDs are mounted within the diffuser. The diffuser may have two substantially flat sides extending substantially over the length of the elongated translucent diffuser on either side of the flat top wall. The diffuser may have sides that are substantially orthogonal to the top wall or that are at an angle to the top wall. Mounting structure for attaching the LEDs may be integrated with the housing or with the diffuser.

Other aspects, features, and advantages of the invention will become apparent to those skilled in the art from the following detailed description and accompanying drawings. It should be understood, however, that the detailed description and specific examples, while indicating certain embodiments of the present invention, are given by way of illustration and not of limitation. Many changes and modifications may be made within the scope of the present invention without departing from the spirit thereof, and the invention includes all such modifications.

DESCRIPTION OF THE DRAWINGS

An exemplary embodiment of the invention is illustrated in the accompanying drawings in which like reference numerals represent like parts throughout.

In the drawings.

DETAILED DESCRIPTION

Referring now to the Figures, and initially to FIGS. 1-7, this invention relates to a lighting arrangement, such as an arrangement used to simulated neon light, which uses light emitting diodes (LED's) 27 as a light source to illuminate simulated neon lights, which are generally represented at 20.

Figure 1:
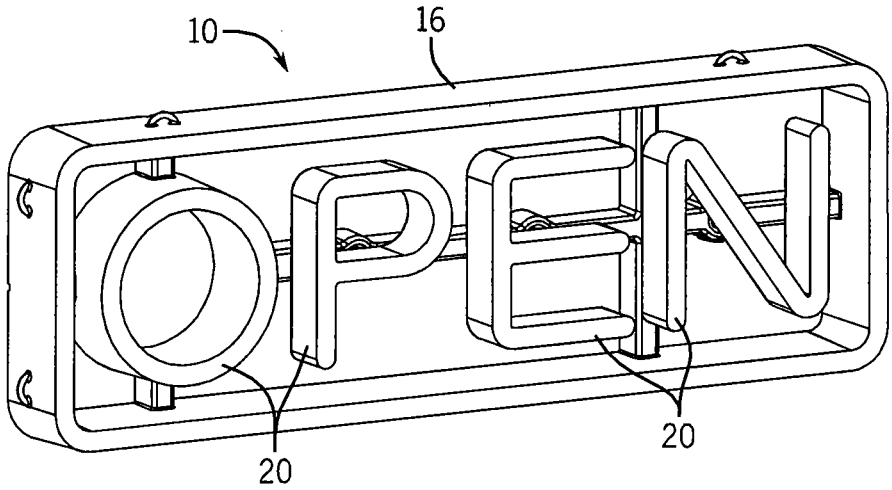
FIG. 1 is a isometric view of a sign according to the present invention.

A representative embodiment of the present invention is a sign 10, illustrated in FIG. 1 as an "OPEN" sign that is formed of a series of neon lights 20. However, it is understood that simulated neon lights 20 may be configured in a variety of shapes to display a variety of messages and designs of various colors and sizes as a sign or otherwise. It is also understood that the present invention may be used in any application, and that its use in the context of a simulated neon sign is but one illustrative example of the many applications in which the present invention may be used. In this representative embodiment, sign 10 includes a frame 16 configured for mounting the simulated neon lights 20. The simulated neon lights 20 in this embodiment are the quadrilateral border and letters 'O', 'P', 'E', and 'N' as shown in FIG. 1.

Figure 2:
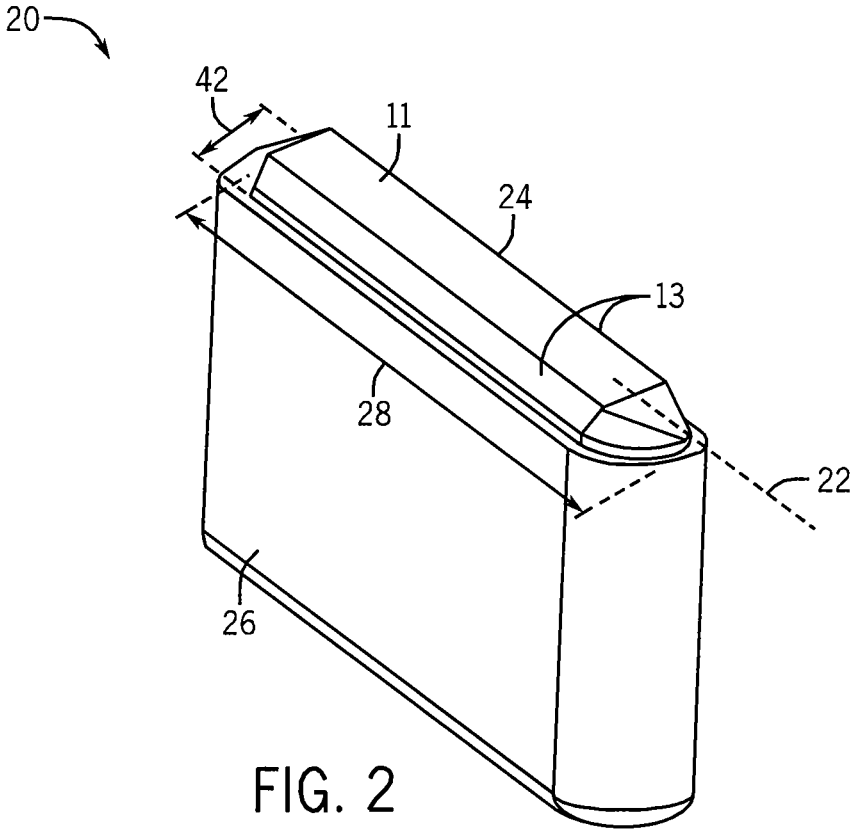
FIG. 2 is an isometric view of a simple linear segment of a sign such as that shown in FIG. 1 according to the present invention, showing a portion of an elongated housing and a light emitting diffuser or waveguide.

FIG. 2 shows a portion of one of the simulated neon lights 20, which includes a housing 26 and a waveguide diffuser 24 having a long axis 22, a width 42, and a length 28 wherein the diffuser 24 is securably attached to the housing 26. The waveguide 24 has a substantially flat upper surface 11 and substantially flat side surfaces 13. Housing 26 is preferably constructed from an opaque, lightweight and durable material such as plastic. Alternatively, housing 26 may be constructed from a relatively lightweight metal such as aluminum or the like through an extrusion or similar such process. Diffuser 24 is preferably constructed from a translucent lightweight and durable material such as plastic that has the quality of being able to diffuse light. In one embodiment the diffuser 24 may be tinted to emit a different color of light, and may have a shiny or glassy appearance. Alternatively, diffuser 24 may be constructed of glass, tinted or otherwise.

Figure 3A:
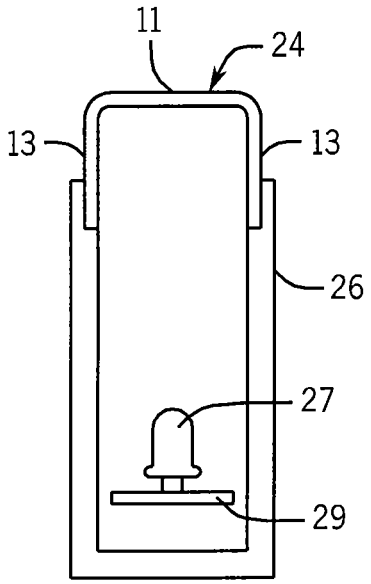
FIG. 3*a* is a cross-sectional view of the sign segment of FIG. 2 according to the present invention, showing an embodiment of a 3-sided waveguide and the attached housing.

Referring now to FIG. 3*a*, a transverse cross-section of the simulated neon light 20 is shown having a three-sided diffuser 24 attached to a housing 26 wherein the housing 26 contains a series of LEDs 27 securably attached to an LED mounting structure, such as a circuit board 29. The LED mounting structure 29 may be securably attached to the housing 26 in any satisfactory manner. The LEDs 27 are energized by a power supply such that the LEDs 27 emit a light that is transmitted through the diffuser 24. In the embodiment shown in FIG. 3*a*, the diffuser 24 has an open bottom such that light emitted from the LEDs 27 passes into the interior of the diffuser 24 and impinges directly on the top wall 11 and side walls 13.

Figure 3B:
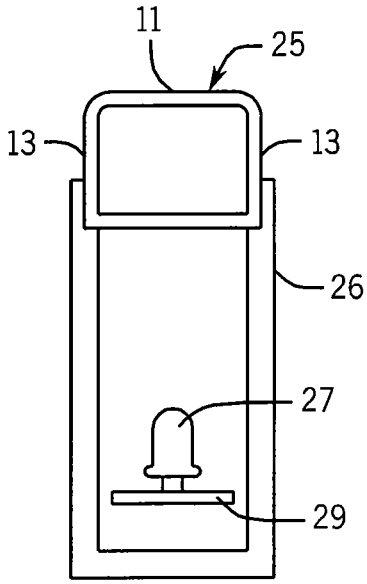
FIG. 3*b* is a cross-sectional view similar to FIG. 3 showing an embodiment of a 4-sided waveguide and the attached housing.

In another embodiment as shown in FIG. 3*b*, a similarly configured diffuser, shown at 25, has a closed configuration. In this embodiment, the diffuser 25 is in the form of a four-sided substantially rectangular waveguide attached to the housing 26 that contains a series of LEDs 27 securably attached to an LED mounting structure 29. In some embodiments, the LED mounting structure 29 is integrated with the housing 26 as will be described in detail below.

Figure 4A:
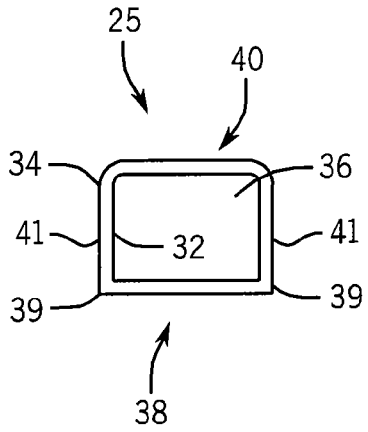
FIG. 4*a* is a cross-sectional view of the 4-sided waveguide as shown in FIG. 3*b;*

Referring now to FIG. 4*a*, a transverse cross-section of the closed four-sided diffuser 25 is shown having a contiguous (i.e. closed) inner surface 32 with an outer surface 34 forming a hollow interior 36. The closed translucent diffuser 25 has a substantially flat bottom wall 38 having ends 39, and a top wall 40 connected to the bottom wall ends 39 by side walls 41, forming interior 36. The bottom wall 38 is integrated with the top wall 40 and the side walls 41.

Figure 4B:
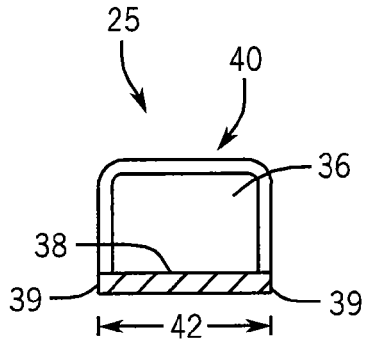
FIG. 4*b* is a cross-sectional view of another embodiment of a 4-sided waveguide similar to that shown in FIG. 4*a;*

Referring to FIGS. 4*a*-4*b*, in one embodiment if the waveguide 25, the bottom wall 38 may be integral and it may consist of the same material as the top wall as shown in FIG. 4*a*. Alternatively, referring specifically to FIG. 4*b*, the bottom wall 38 may be formed separately and securably attached to the top wall 40. In this embodiment, the bottom wall 38 may consist of a different material than the top wall 40 and side walls 41. The bottom wall 38 may extend across the entire width 42 of the opening formed by the top wall 40 and side walls 41, as shown in FIG. 4*b*.

Figure 4C:
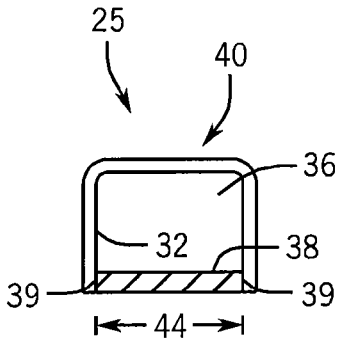
FIG. 4*c* is a cross-sectional view of yet another embodiment of a 4-sided waveguide similar to that shown in FIGS. 4*a* and 4*b;*

Referring now to FIG. 4*c*, in yet another embodiment the bottom wall 38 may extend across the width 44 of the opening defined by the top wall 40 and the inside surfaces of the side walls 41, such that the bottom wall 38 is extends between and is secured to the inside surfaces of the side walls 41 at an elevation flush with the bottom ends of the side walls 41. Other embodiments that are not shown may have differing configurations of the top wall and bottom wall.

Diffuser bottom wall 38, 42, 44 is preferably constructed from a lightweight and durable material such as plastic that has the quality of being able to diffuse or transmit light, and may be tinted to emit a different color of light. In one embodiment the material of the bottom wall 38, 42, 44 may be the same as the top wall 40 and/or side walls 41. In another embodiment the bottom wall 38 may be a material different than that of the top wall 40 and/or side walls 41. In yet another embodiment the bottom wall 38, 42, 44 may be glass.

Diffuser top wall 40 is preferably constructed from a lightweight and durable material such as plastic that has the quality of being able to diffuse light, which may be tinted to emit a different color of light, and may have a shiny or glassy appearance. Alternatively, diffuser top wall 40 may be constructed of tinted glass.

Figure 4D:
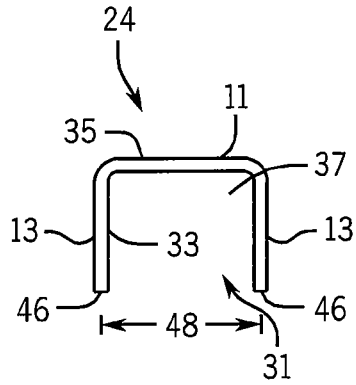
FIG. 4*d* is a cross-sectional view of 4*a* 3-sided diffuser like that shown in FIG. 3A.

Referring now to FIG. 4*d*, in one embodiment the diffuser 24 may be open, i.e. it may have a channel shape defining a downwardly open slot extending along its length such that the diffuser 24 is three-sided when viewed in cross-section. The open diffuser 24 is shown to have a non-contiguous (i.e. open) inner surface 33 with an outer surface 35 forming an interior 37 and a flat open side 31 having bottom edges 46 separated by a distance 48. In addition, the outer surface 35 has a substantially flat top surface 11 and substantially flat side surfaces 13.

Figure 5A:
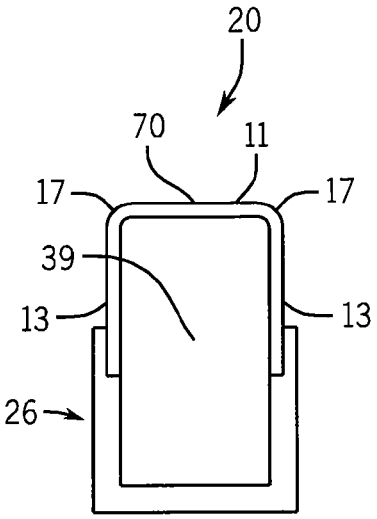
FIG. 5*a* is a cross-sectional view similar to FIG. 3*a* showing a 3-sided waveguide and housing having a substantially rectangular configuration.

Turning now to FIG. 5*a*, in one embodiment of the present invention, an open diffuser 70 mounted on housing 26 may have a transverse cross section that forms a three-sided substantially rectangular diffuser 70 with an open bottom aperture 39, substantially flat sides 13, and a substantially flat top 11. The diffuser 70 may also have substantially rounded corners 17. In another embodiment, the corners 17 are not rounded but instead are substantially sharp. In yet another embodiment the diffuser may have sides 13 of unequal height producing a cross-section that is an open non-isosceles quadrangle rather than an open rectangle.

Figure 5B:
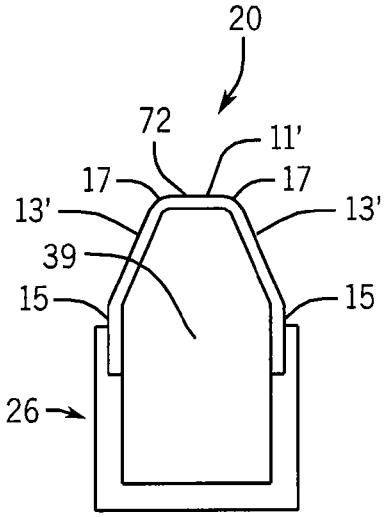
FIG. 5*b* is a cross-sectional view similar to FIG. 5*a* showing a 5-sided waveguide and housing having a substantially trapezoidal configuration.

Referring to FIG. 5*b*, in another embodiment an open diffuser 72 mounted on housing 26 may have a transverse cross section that forms an open substantially trapezoidal diffuser 72 with an open bottom aperture 39, substantially flat sides 13', and a substantially flat top 11'. The diffuser 72 may also have substantially flat vertical portions of the sides 15 to mate with facing shoulders defined by housing 26. In another embodiment the sides 13 may not have vertical portions 15 (not shown). The diffuser 72 may also have substantially rounded corners 17. In another embodiment the corners 17 are not rounded but instead are substantially sharp. In yet another embodiment the diffuser may have sides 13 of unequal height producing a cross-section that is an open non-isosceles trapezoid rather than the open isosceles trapezoid that is shown.

Figure 6A:
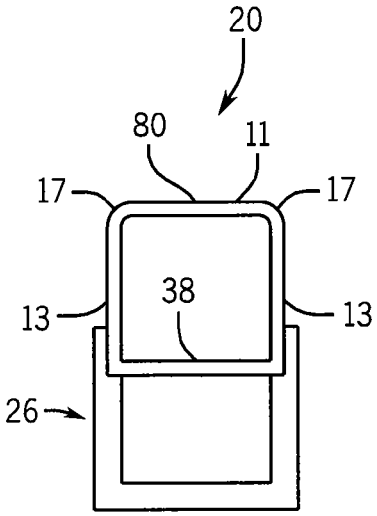
FIG. 6*a* is a cross-sectional view similar to FIG. 3*b* showing a 4-sided waveguide and housing having a substantially rectangular configuration.

Turning now to FIG. 6*a*, in one embodiment a closed diffuser 80 mounted on housing 26 may have a transverse cross section similar to FIG. 4*a*, that forms a closed four-sided substantially rectangular configuration with a flat bottom wall 38, substantially flat sides 13, and a substantially flat top 11. The diffuser 80 may also have substantially rounded corners 17. In another embodiment the corners 17 are not rounded but instead are substantially sharp. In yet another embodiment the diffuser may have sides 13 of unequal height producing a cross-section that is a non-isosceles quadrangle rather than a rectangle.

Figure 6B:
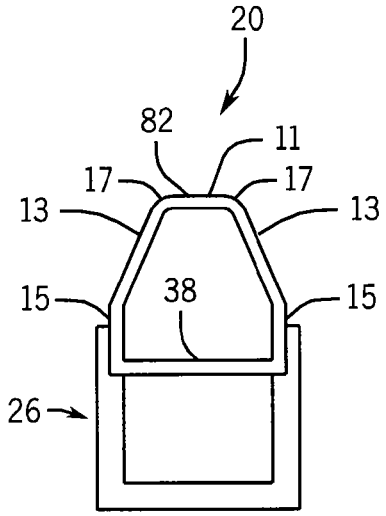
FIG. 6*b* is a cross-sectional view similar to FIG. 6*a* showing a 5-sided waveguide and housing having a substantially trapezoidal configuration.

Referring to FIG. 6*b*, in another embodiment a closed diffuser 82 mounted on housing 26 may have a transverse cross section that forms a closed substantially trapezoidal configuration with a flat bottom wall 38, substantially flat sides 13, and a substantially flat top 11. The diffuser 82 may also have substantially flat vertical portions of the sides 15 to mate with facing shoulders defined by housing 26. In another embodiment the sides 13 may not have vertical portions 15 (not shown). The diffuser 72 may also have substantially rounded corners 17. In another embodiment the corners 17 are not rounded but instead are substantially sharp. In yet another embodiment the diffuser may have sides 13 of unequal height producing a cross-section that is an open non-isosceles trapezoid rather than the open isosceles trapezoid that is shown.

Figure 7:
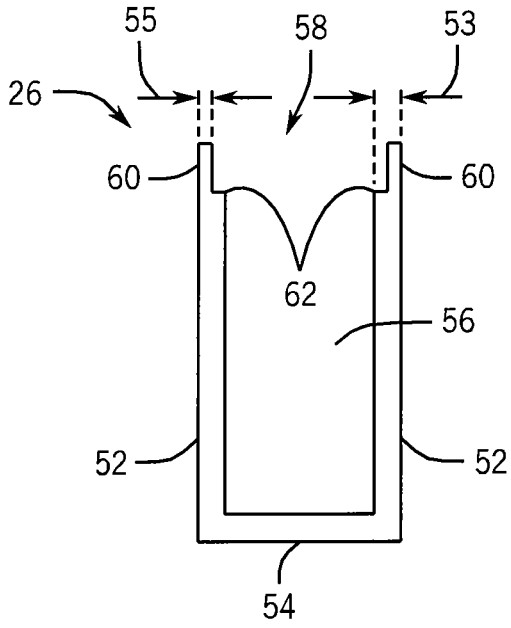
FIG. 7 is a cross-sectional view showing an embodiment of the elongate housing without a waveguide, such as is incorporated in the assembly views shown in FIGS. 1-3*b* and 5*a*-6*b;*

Referring now to FIG. 7, one embodiment of the housing 26 has an open side 58. A transverse cross-section of housing 26 is shown having side walls 52, and a bottom 54 forming an interior 56 and the open side 58. The housing 26 may have arms 60 having a width 55 narrower than the width of side walls 52. Arms 60 are either securably attached or integral to walls 52 and arranged so that the juncture of the arm 60 with the wall 52 forms a shoulder 62 on the inner surface of the wall 52. The shoulders 62 are configured to receive the diffuser in aperture 58 as shown, for example, in FIG. 3*a* and FIG. 3*b*.

Figure 8A:
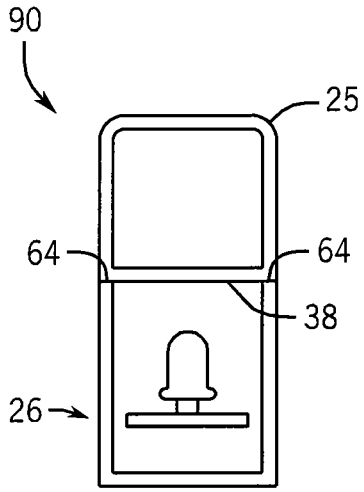
FIG. 8*a* is a cross-sectional view similar to FIGS. 3*a*, 3*b* and 5*a*-6*c*, showing an embodiment of a 4-sided substantially rectangular waveguide and an alternate embodiment of the housing.

Turning to FIG. 8*a*, in another embodiment 90, the housing 26 has top edges 64 which receive the diffuser 25 to attach the housing 26 to the waveguide bottom wall 38.

Figure 8B:
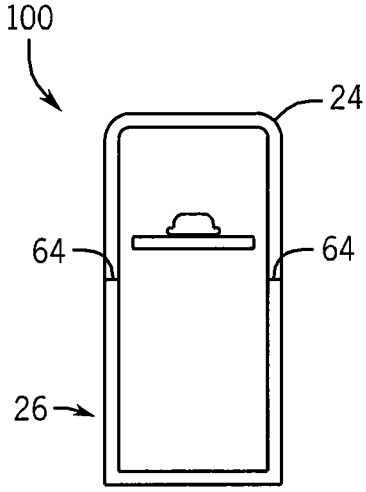
FIG. 8*b* is a cross-sectional view similar to FIG. 8*a*, showing an embodiment of a 3-sided waveguide and an alternate embodiment of the housing, with the LED and circuit board mounted within the waveguide.

Referring now to FIG. 8*b*, in yet another embodiment 100, the housing 26 has top edges 64 which receive the open diffuser 24 to attach the housing 26 to the waveguide bottom edges.

Figure 9A:
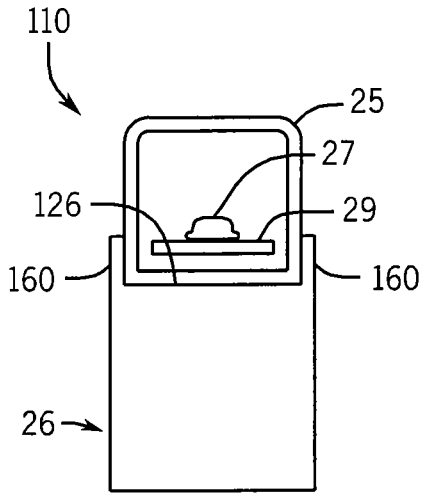
FIG. 9*a* is a cross-sectional view similar to FIGS. 3*a*, 3*b* and 5*a*-6*c*, showing an embodiment of a 4-sided substantially rectangular waveguide with the LED and circuit board mounted within the waveguide and attached to a substantially solid housing.

Turning to FIG. 9*a*, in another embodiment 110, the housing 26' is substantially solid and has arms 160 and a surface 126 configured to receive the closed diffuser 25. The closed diffuser 25 contains the LEDs 27 and supporting structure 29.

Figure 9B:
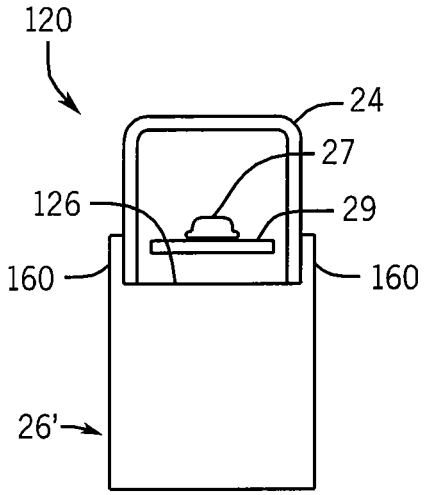
FIG. 9*b* is a cross-sectional view similar to FIG. 9*a*, showing an embodiment of a 3-sided waveguide and a substantially solid housing.

Referring now to FIG. 9*b*, in another embodiment 120, the housing 26' is substantially solid and has arms 160 and a surface 126 configured to receive the open diffuser 24. The open diffuser 24 contains the LEDs 27 and supporting structure 29.

Figure 10A:
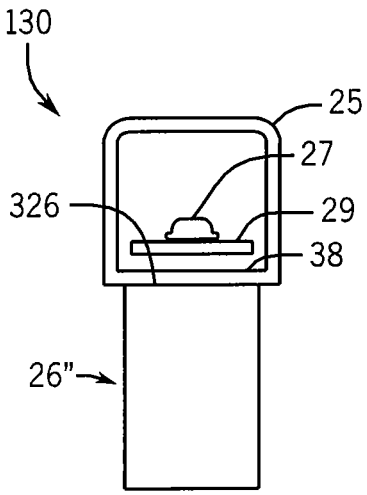
FIG. 10*a* is a cross-sectional view similar to FIGS. 9*a* and 9*b*, showing an embodiment of a 4-sided substantially rectangular and a substantially solid housing that is narrower than the waveguide.
Figure 10B:
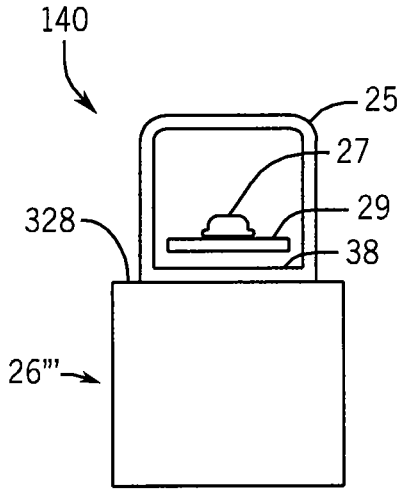
FIG. 10*b* is a cross-sectional view similar to FIG. 10*a*, showing an embodiment of a 4-sided substantially rectangular waveguide and a substantially solid housing that is wider than the waveguide.
Figure 10C:
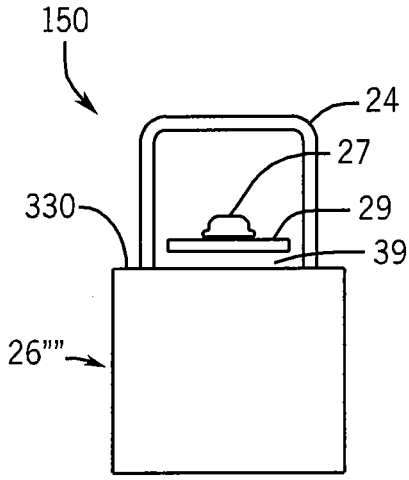
FIG. 10*c* is a cross-sectional view similar to FIGS. 10*a* and 10*b*, showing an embodiment of a 3-sided waveguide and a substantially solid housing that is wider than the waveguide.

Referring to FIGS. 10*a*-10*c*, the embodiments 130, 140, 150 show differing widths of the housing 26 relative to the diffuser. Referring to FIG. 10*a*, an embodiment of the present invention 130 may have a housing 26" that is substantially solid that receives the closed diffuser 25 on a top surface 326 that is narrower than the bottom 38 to which the diffuser 25 is attached, with the diffuser 25 having the LEDs 27 and circuit board assembly 29 mounted within.

Turning to FIG. 10*b*, an embodiment 140 may have a housing 26''' that is substantially solid that receives the closed diffuser 25 on a top surface 328 that is wider than the bottom 38 to which the diffuser 25 is attached, with the diffuser 25 having the LEDs 27 and circuit board assembly 29 mounted within.

Referring now to FIG. 10*c*, an embodiment 150 may have a housing 26'''' that is substantially solid that receives the open diffuser 24 on a top surface 330 that is wider than the diffuser open side 39 to which the diffuser 24 is attached, with the diffuser 24 having the LEDs 27 and circuit board assembly 29 mounted within.

In yet another embodiment the housing 26 is substantially solid and has substantially the same width as the diffuser (not shown).

Figure 11A:
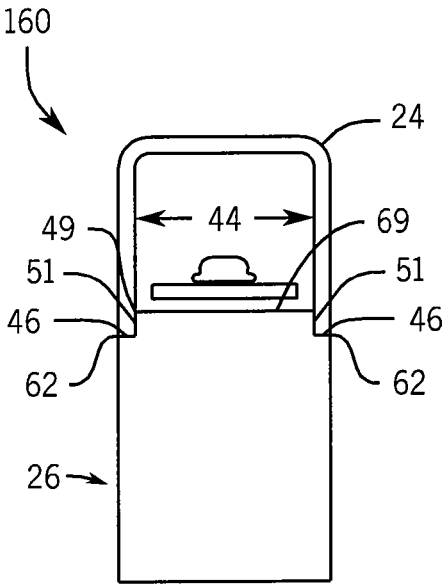
FIG. 11*a* is a cross-sectional view similar to FIGS. 9*a*-10*c*, showing an embodiment of a 3-sided waveguide and an alternate embodiment of a substantially solid housing.
Figure 11B:
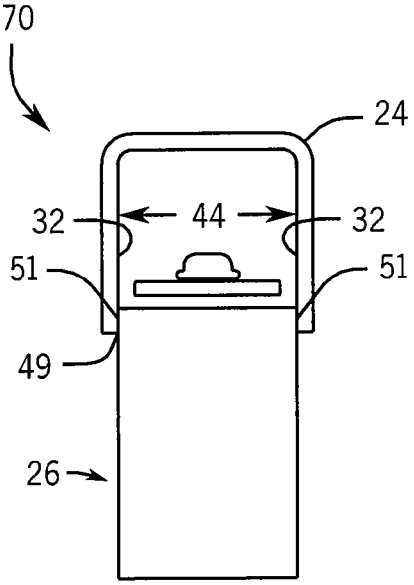
FIG. 11*b* is a cross-sectional view similar to FIG. 11*a*, showing an embodiment of a 3-sided waveguide and another alternate embodiment of a substantially solid housing.

Turning now to FIGS. 11*a* and 11*b*, the open diffuser 24 of an embodiment of the present invention shown at 160, 170, respectively, may surround a portion of the housing 26 such that the inner width 44 of diffuser 24 is substantially the same width as the upper portion of the housing, shown at 49. In this embodiment, the diffuser 24 is in communication with the upper portion of the housing 49 which provides surfaces 51 to which the diffuser 24 and the LED mounting structure 29, such as the circuit board assembly, can be attached.

Specifically referring to FIG. 11*a*, in the embodiment 160 the housing 26 has a raised topmost pedestal 69 that forms outer shoulders 62 with a width capable of receiving diffuser bottom edges 46 for securably attaching the diffuser 24 to housing 26.

Turning to FIG. 11*b*, in yet another embodiment 170 the diffuser 24 is attached to the housing 26 through communication with diffuser inner surface 32 and housing outer surface 51 with no supporting shoulders 62 (as shown in FIG. 11*a*).

Figure 12:
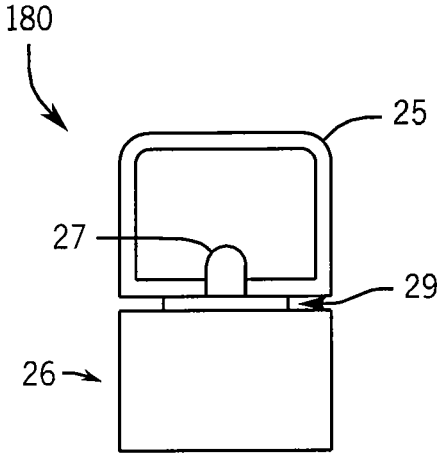
FIG. 12 is a cross-sectional view showing an embodiment of a 4-sided substantially rectangular waveguide with the LED and circuit board attached to the outside the waveguide with the circuit board attached to the housing.

Referring to FIG. 12, in another embodiment 180, the diffuser 25 is securably attached to the LED mounting structure 29, which, in turn, is attached to the housing 26 such that the diffuser 25 is not directly mounted to housing 26. In this embodiment, the LED mounting structure, which may be the circuit board assembly, is sandwiched between the lower wall of the diffuser 25 and the upper surface of the housing 26.

Figure 13A:
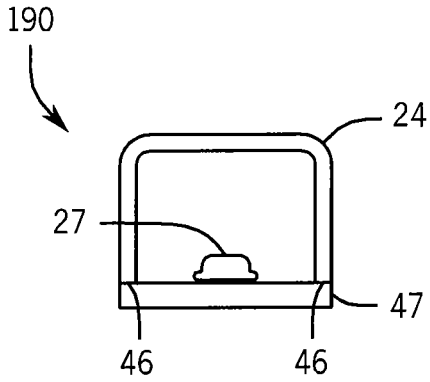
FIG. 13*a* is a cross-sectional view showing an embodiment of a 3-sided substantially rectangular waveguide with the LED mounted within the waveguide on a circuit board that also serves as a wall of the housing.
Figure 13B:
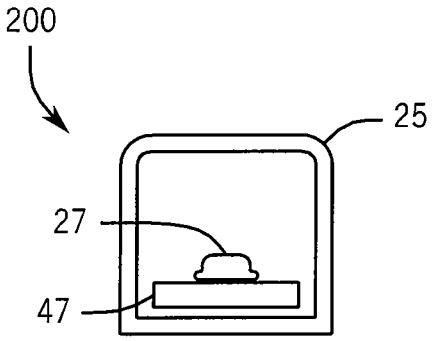
FIG. 13*b* is a cross-sectional view showing an embodiment of a 4-sided substantially rectangular waveguide with the LED and circuit board mounted within the waveguide without an external housing.
Figure 13C:
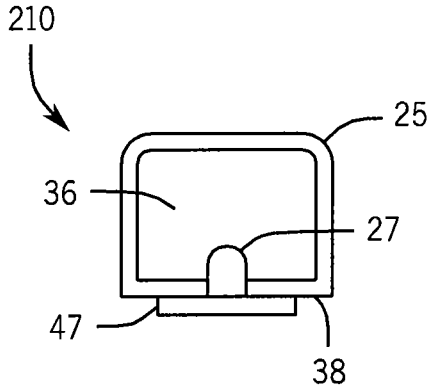
FIG. 13*c* is a cross-sectional view showing an embodiment of a 4-sided substantially rectangular waveguide with the LED mounted within the waveguide on a circuit board secured to the housing.

Referring now to FIGS. 13*a*-*c*, in other embodiments the LED mounting structure is integrated with or mounted directly to the diffuser. The diffuser 24, 25 may then be attached to housing, which also serves as a mounting structure for LEDs 27, or the diffuser 24, 25 may be employed separately from any housing or other supporting or mounting structure.

Turning now to FIG. 13*a*, in this embodiment 190 the open diffuser 24 has bottom edges 46 that are securably attached to an integrated mounting structure/circuit board 47 to which the LEDs 27 are secured. An alternate embodiment 200 is shown in FIG. 13*b*, in which the closed diffuser 25 is securably attached to the mounting structure 47 to which the LEDs 27 are mounted such that the LEDs and mounting structure are enclosed within the interior of the diffuser 25.

Referring to FIG. 13*c*, in another embodiment 210, the LEDs 27 are partially within the interior 36 of the closed diffuser 25, and the mounting structure 47 is securably attached to the bottom wall 38 of diffuser 25.

Mounting structure 47 may be constructed from a relatively sturdy and durable material that is generally lightweight such as plastic, phenolic, cotton paper with epoxy, polyester, woven glass, or some combination of materials. In one embodiment, mounting structure 47 is a substantially opaque material. Mounting structure 47 may be constructed by a circuit board making process of the kind generally known in the art.

Figure 14A:
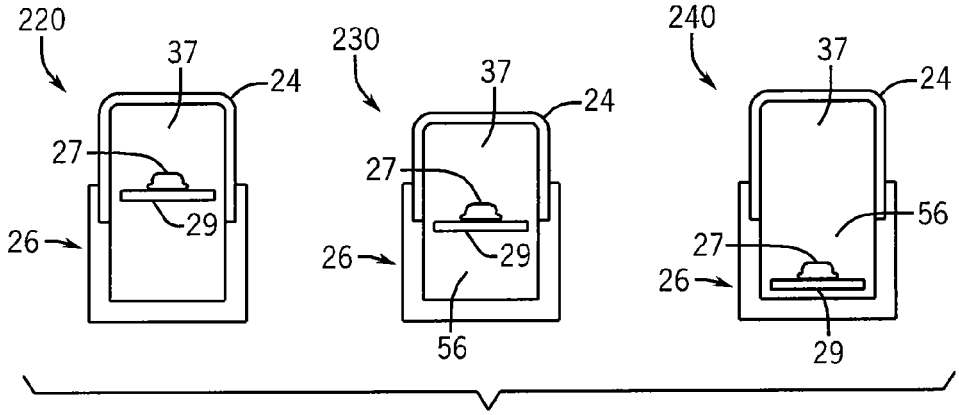
FIG. 14*a* contains cross-sectional views similar to FIG. 3*a* showing the LED and circuit board assembly positioned at three different locations within the waveguide and housing assembly.

Referring to FIG. 14*a*, the position of the LEDs 27 and circuit board 29, within a lighting arrangement with an open diffuser 24, may be varied in different embodiments. In one embodiment 220 the LEDs 27 and circuit board 29 are substantially within the interior 37 of open diffuser 24. In another embodiment 230 the LEDs 27 and circuit board 29 are within both a portion of the housing interior 56 and the diffuser interior 37, and in yet another embodiment 240 the LEDs 27 and circuit board 29 are within the housing interior 56.

Figure 14B:
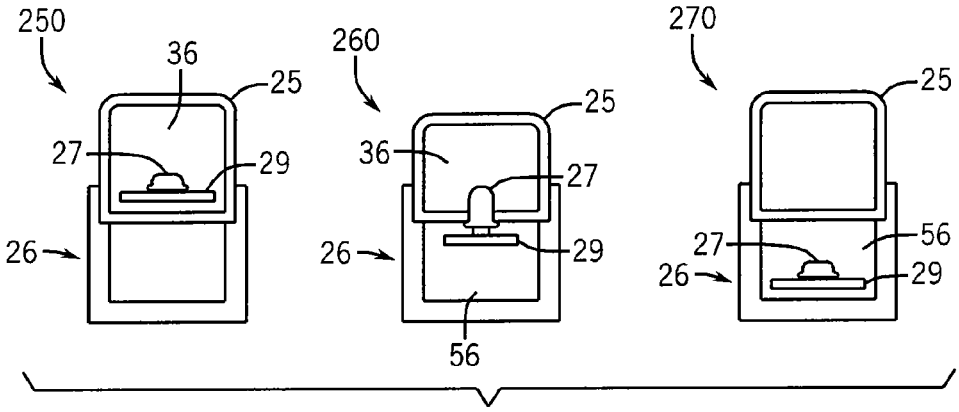
FIG. 14*b* contains cross-sectional views similar to FIG. 3*b* showing the LED and circuit board assembly positioned at three different locations within the waveguide and housing assembly.

Turning now to FIG. 14*b*, the position of the LEDs 27 and circuit board 29, within a lighting arrangement with a closed diffuser 25, may be varied in different embodiments. In one embodiment 250 the LEDs 27 and circuit board 29 are substantially within the interior 36 of closed diffuser 25. In another embodiment 260 the LEDs 27 and circuit board 29 are within both a portion of the housing interior 56 and the diffuser interior 36, and in yet another embodiment 270 the LEDs 27 and circuit board 29 are within the housing interior 56.

LEDs 27 preferably emit light within at least one frequency of the human visible spectrum. In one embodiment, the LEDs 27 emit light within substantially a single frequency of visible light appearing to the human eye as a single color. In another embodiment, the LEDs 27 emit multiple frequencies of light either one frequency at a time or in combination such that it produces multiple visible colors.

Although the best mode contemplated by the inventors of carrying out the present invention is disclosed above, practice of the present invention is not limited thereto. It is further contemplated that various additions, modifications and rearrangements of the features of the present invention may be made without deviating from the spirit and scope of the underlying inventive concept.

We claim:

1. A simulated neon light comprising, at least one elongated translucent diffuser having an inner surface, an outer surface, and a hollow interior wherein the outer surface has a flat top portion extending substantially over the length of the elongated translucent diffuser, and wherein the elongated translucent diffuser has a pair of parallel, opposing side wall portions extending over the length of the elongated translucent diffuser and which extend upwardly from a bottom of the elongated translucent diffuser;

a housing that is configured for attachment to the translucent diffuser;

a plurality of light emitting diodes (LEDs) aligned with a long axis of the elongated translucent diffuser whereby the light emitting diodes when energized emit light striking the inner surface of the elongated translucent diffuser wherein a portion of the light striking the inner surface is diffused and emitted by the flat top portion of the outer surface; and an electrical power source for energizing the light emitting diodes.

2. The simulated neon light of claim 1 wherein the elongated housing has an interior space and at least one open side.

3. The simulated neon light of claim 1 wherein the elongated housing is substantially solid.

4. The simulated neon light of claim 1 wherein the housing has topmost mounting elements having at least one horizontal surface in communication with at least one elongated translucent diffuser lower surface.

5. The simulated neon light of claim 4 wherein the housing topmost mounting elements further comprise a vertical surface in communication with an elongated translucent diffuser side surface.

6. The simulated neon light of claim 1 wherein the elongated translucent diffuser has a closed boundary extending substantially over the length of the elongated translucent diffuser and forming the hollow interior.

7. The simulated neon light of claim 6 wherein the elongated translucent diffuser comprises an assembly having a top wall portion and a securably attached bottom wall.

8. The simulated neon light of claim 7 wherein the bottom wall is made of a material selected from a group consisting of a transparent, a translucent and a non-opaque material.

9. The simulated neon light of claim 1 wherein a bottom of the diffuser has an opening configured for inserting at least a portion of at least one light emitting diode into the hollow interior of the diffuser.

10. The simulated neon light of claim 1 wherein the side wall portions of the diffuser are substantially orthogonal to the top portion.

11. The simulated neon light of claim 10 wherein the side wall portions of the elongated translucent diffuser are differing heights.

12. The simulated neon light of claim 1 wherein the side wall portions of the diffuser are substantially not orthogonal to the top portion.

13. The simulated neon light of claim 12 wherein the side wall portions of the diffuser further comprise lower portions that are configured for attachment to receiving portions associated with the housing.

14. The simulated neon light of claim 1 further comprising a mounting structure for attaching the LEDs.

15. The simulated neon light of claim 14 wherein the mounting structure is integrated with the elongated housing.

16. The simulated neon light of claim 1 wherein the LEDs are mounted within the housing.

17. A simulated neon light comprising:

at least one elongated translucent diffuser having an inner surface, an outer surface, and a hollow interior, wherein the outer surface has a flat top portion extending substantially over the length of the elongated translucent diffuser, wherein the elongated translucent diffuser further has an open side extending substantially over the length of the elongated translucent diffuser;

a housing that is configured for attachment to the translucent diffuser;

a plurality of light emitting diodes contained within the housing and aligned with a long axis of the elongated translucent diffuser whereby the light emitting diodes when energized emit light striking the inner surface of the elongated translucent diffuser, wherein a portion of the light striking the inner surface is diffused and emitted by the flat top portion of the outer surface; and an electrical power source for energizing the light emitting diodes.

18. The simulated neon light of claim 17 wherein the outer surface of the elongated translucent diffuser has two substantially flat sides extending substantially over the length of the elongated translucent diffuser.

19. The simulated neon light of claim 18 wherein the diffuser has sides that are substantially not orthogonal to the top portion.

20. The simulated neon light of claim 19 wherein the sides further comprise lower portions that are configured for attachment to receiving portions associated with the housing.

21. The simulated neon light of claim 18 wherein the are substantially orthogonal to the top portion.

22. The simulated neon light of claim 21 wherein the elongated translucent diffuser sides are differing heights.

23. The simulated neon light of claim 17 wherein the housing has topmost mounting elements having at least one upstanding surface that faces and engages at least one elongated translucent diffuser side surface.

24. A simulated neon light comprising:

at least one elongated translucent diffuser having an inner surface, an outer surface, and a hollow interior, wherein the outer surface has a flat top portion extending substantially over the length of the elongated translucent diffuser, and wherein the elongated translucent diffuser has a pair of side walls extending over the length of the elongated translucent diffuser, wherein the side walls have different heights;

a housing that is configured for attachment to the translucent diffuser;

a plurality of light emitting diodes contained within the housing and aligned with a long axis of the elongated translucent diffuser whereby the light emitting diodes when energized emit light striking the inner surface of the elongated translucent diffuser, wherein a portion of the light striking the inner surface is diffused and emitted by the flat top portion of the outer surface; and an electrical power source for energizing the light emitting diodes.

* * * * *

UNITED STATES PATENT AND TRADEMARK OFFICE

CERTIFICATE OF CORRECTION

PATENT NO. : 8,449,140 B2
APPLICATION NO. : 12/882910
DATED : May 28, 2013
INVENTOR(S) : John D. Martin et al.

It is certified that error appears in the above-identified patent and that said Letters Patent is hereby corrected as shown below:

In the Claims:

Claim 21, column 10, line 30, before "are" insert -- sides --.

Signed and Sealed this
Second Day of July, 2013

Teresa Stanek Rea
*Acting Director of the United States Patent and Trademark Office*